US005987674A

United States Patent [19]

Schaffner et al.

[11] Patent Number: 5,987,674

[45] Date of Patent: Nov. 23, 1999

[54] ERGONOMIC PILLOW

[76] Inventors: Todd Schaffner, 643 Collier Rd., Atlanta, Ga. 30318; Casey Powell, 3219-I Post Woods Dr., Atlanta, Ga. 30339

[21] Appl. No.: 08/812,079

[22] Filed: Mar. 6, 1997

Related U.S. Application Data

[63] Continuation-in-part of application No. 29/041,432, Jul. 13, 1995, Pat. No. Des. 382,435

[60] Provisional application No. 60/012,919, Mar. 6, 1996.

[51] Int. Cl.[6] ..... A47G 9/00

[52] U.S. Cl. ..... 5/632; 5/630; 5/652

[58] Field of Search ..... 5/632, 636, 645, 5/630, 652

[56] References Cited

U.S. PATENT DOCUMENTS

| | | | |
|---|---|---|---|
| D. 201,492 | 6/1965 | Jacobson . | |
| D. 230,804 | 3/1974 | Lijewski | 5/636 X |
| D. 382,435 | 8/1997 | Schaffner et al. | 5/645 X |
| 673,872 | 5/1901 | Von Hillern-Flinsch | 5/645 X |
| 726,164 | 4/1903 | Hogan et al. | 5/630 |
| 1,343,357 | 6/1920 | Eggers | 5/630 X |
| 1,787,832 | 1/1931 | Mueller | 5/636 |
| 2,149,140 | 2/1939 | Gonzalez-Rincones . | |
| 2,328,871 | 9/1943 | Woehler | 5/636 |
| 2,561,931 | 7/1951 | Kleiser, Jr. | 5/636 X |
| 3,312,987 | 4/1967 | Emery | 5/636 X |
| 3,327,330 | 6/1967 | McCullough . | |
| 3,848,281 | 11/1974 | Mathews | 5/636 |
| 3,911,512 | 10/1975 | Plate | 5/636 X |
| 4,060,863 | 12/1977 | Craig . | |
| 4,173,048 | 11/1979 | Varaney . | |
| 4,287,621 | 9/1981 | Kertz | 5/636 |
| 4,574,412 | 3/1986 | Smith . | |
| 4,617,691 | 10/1986 | Monti et al. | 5/636 X |
| 4,679,262 | 7/1987 | Davis et al. | 5/636 X |
| 4,731,890 | 3/1988 | Roberts . | |
| 4,754,510 | 7/1988 | King . | |
| 4,780,920 | 11/1988 | White | 5/636 |
| 4,794,657 | 1/1989 | Avery . | |
| 4,819,287 | 4/1989 | Halverson | 5/632 X |
| 4,901,384 | 2/1990 | Eary . | |
| 5,097,551 | 3/1992 | Smith | 5/632 X |
| 5,109,557 | 5/1992 | Koy et al. . | |
| 5,261,134 | 11/1993 | Matthews | 5/630 X |
| 5,313,678 | 5/1994 | Redewill | 5/636 X |
| 5,519,906 | 5/1996 | Fanto-Chan | 5/636 X |
| 5,579,551 | 12/1996 | Tommaney | 5/632 X |
| 5,604,944 | 2/1997 | Meade | 5/636 X |
| 5,642,543 | 7/1997 | Huntley | 5/645 X |
| 5,661,861 | 9/1997 | Matthews | 5/636 X |
| 5,836,024 | 11/1998 | Uglehus et al. | 5/636 |

*Primary Examiner*—Terry Lee Melius
*Assistant Examiner*—Robert G. Santos
*Attorney, Agent, or Firm*—Patton Boggs LLP

[57] ABSTRACT

The invention relates to an ergonomically designed pillow having a shape that offers support for a user's head and/or limbs through a portion of their range of motion with respect to the user's torso without having to reposition or reconfigure the pillow. In the preferred embodiment the pillow has a substantially fixed radius curved shape designed to correspond to the rotation of the head with respect to the shoulders. Therefore, the head of a user resting on their side can be comfortably supported on the pillow and will be similarly supported as the head is rotated forward and backward with respect to the shoulders. In addition, this substantially uniform curved design enables the pillow to be rotated forward or backward and provide the same head support while also providing support for the user's arms or back, respectively.

14 Claims, 3 Drawing Sheets

ERGONOMIC PILLOW

CROSS-REFERENCE TO RELATED APPLICATIONS

This application claims the benefit of U.S. Provisional Application No. 60/012,919 filed Mar. 6, 1996 which is herein incorporated by reference. This application is a continuation-in-part of Design application Ser. No. 29/041,432, filed Jul. 13, 1995, now U.S. Pat. No. Des. 382,435.

FIELD OF THE INVENTION

The present invention relates to an ergonomically designed pillow for supporting the head or head and limbs of a person through their natural rotation with respect to the torso. More particularly, this invention relates to an ergonomically designed pillow comprising a curved or a series of integrally connected curved and linear portions wherein each curved portion and the arrangement of portions is designed to support a user's head and/or limbs through at least a portion of their rotational movements.

BACKGROUND OF THE INVENTION

Many factors can contribute to resting comfort and overall sleep quality. In terms of sleep satisfaction, sleep positions appear to be related to the quality of sleep one receives. On average, poor sleepers spend more time on their back with their head straight whereas good sleepers occupy more periods of immobility on their sides, commonly referred to as the semi-fetal position. The sleep position of these poor sleepers also appears to correspond with the normal position of sleepers who complain of respiratory problems. Sound sleepers spend more sleep time immobile than poor sleepers while poor sleepers tend to have more movement patterns which seem to disrupt their sleep.

It has been observed that sound sleep is characterized by eight to twelve postural shifts per night, eight hour period, that occur in harmony with the cycles of sleep. These shifts commonly coincide with brief moments of consciousness which, while detectable, go unnoticed by the subject. It is believed that this postural shifting during sleep naturally occurs to stimulate blood flow which works to avoid muscle tension. For these reasons it is believed that some minimal number of postural shifts cannot be avoided.

In contrast, research has shown that some poor sleepers may undergo well over a hundred postural shifts in a typical eight hour sleep period. It is believed that these excessive movements are in response to physical stresses on the body commonly referred to as pressure points. A pressure point occurs when an exceptional amount of pressure is applied for an extended period on a nerve or blood vessel resulting in numbness or pain. In response, the body adjusts to alleviate the pressure. Accordingly, it has been concluded that the quality of sleep is directly related to the comfort level one is able to achieve.

For the average individual, the ability to achieve comfort in a preferred sleeping position is a major step toward improving sleep quality. There have been numerous attempts to design pillows to aid in sleeping comfort as evidenced by the following patents, U.S. Pat. Nos. 3,327,330, 4,060,863, 4,173,048, 4,574,412, 4,754,510 and 4,794,657.

U.S. Pat. No. 3,327,330 relates to an L-shaped pillow with a central body having two wing members that are joined on either side of the body by a transverse seam. The transverse seam acts as a hinge enabling the wings to be folded under the central body. Similarly, U.S. Pat. No. 4,060,863 relates to a substantially V-shaped pillow tapered so that the body presents a substantially flat surface from top to bottom when the arms are folded in contact with each other. Another patent, U.S. Pat. No. 4,731,890 designed to aid mother's during breast feeding, describes a V-shaped pillow having one arm of the perpendicular V-shape wider than the other.

U.S. Pat. No. 4,173,048 relates to a body length pillow with a linear head supporting central portion having two body length extensions extending perpendicularly from the ends of the central portion. U.S. Pat. No. 4,574,412 relates to a L-shaped pillow having a linear head supporting portion with a linear leg portion extending perpendicularly therefrom.

U.S. Pat. No. 4,754,510 relates to a pillow having a pair of generally oval or elliptical shaped portions attached perpendicularly to each other. U.S. Pat. No. 4,794,657 relates to a pillow assembly having a trunk with a head and leg pillow which may be removably attached in different rotational orientations to the trunk pillow.

All these pillows heretofore comprise a combination of linear members extending either linearly or essentially perpendicularly from each other. These linear designs do not approximate the rotational movements of the user's head and/or limbs. Therefore, they do not offer a support range for the rotational movements of the user's head and/or limbs without requiring an active effort on the part of the user to move, typically pull, the pillow into conformity with a particular position of the body. Of course, these pillows need to be repositioned to conform to other body positions. This repositioning or distortion of the pillow from its natural shape causes a stress in the pillow which may result in a counter force on the body, as the pillow attempts to return to a more natural shape. This need to reposition the pillow and the resulting stress combine to inhibit the user from achieving the prolonged comfort necessary for virtually uninterrupted sleep.

For any and all the reasons noted above plus other reasons not discussed herein, it will be appreciated that there is a need for a pillow that is designed to encircle portions of the body and to support the head and/or limbs through a portion of their rotational movements without having to be reconfigured or repositioned.

It therefore an object of this invention to provide a pillow having a shape designed to partially encircle a shoulder of a user resting on their side and support the user's head through substantially the full range of motion of their head with respect to their shoulders.

It is another object of this invention to provide a pillow having a shape designed to partially encircle the neck of a user resting on their back and support the user's head through substantially the full range of motion of their head with respect to their shoulders.

It is still another object of this invention to provide a pillow having a shape designed to partially encircle a shoulder of a user resting on their side and provide a support range that corresponds to the motion of the user's head with respect to their shoulders and a support range for the unsupported arm of the user.

It is yet another object of this invention to provide a full body pillow having a shape designed to partially encircle a portion of the upper body of the user and offer a support range that corresponds to the motion of the user's head with respect to their shoulders while also offering a support range for one or both legs of the user.

It is a further object of this invention to provide a full body pillow designed to offer a support range for the head, arms and legs of the user having a linear portion with a curved portion extending from each end.

It is still a further object of this invention to provide a pillow designed to offer a support range for the head of the user, without having to reposition or reconfigure the pillow, having a substantially fixed radius arc shape.

SUMMARY OF THE INVENTION

The invention relates to an ergonomically designed pillow, having curved portions corresponding to the rotational movement of a human body's head and/or limbs with respect to the torso, that offers a support range for a user's head and/or limbs without having to reposition or reconfigure the pillow. In the preferred embodiment, the pillow has a substantially fixed radius curved shape designed to correspond to the rotation of the head with respect to the shoulders. Therefore, the head of a user resting on their side can be comfortably supported on the pillow and will be similarly supported as the head is rotated forward and backward with respect to the shoulders. In addition, this substantially uniform curved design enables the pillow to be rotated forward or backward and provide the same head support while also providing support for the user's arms or back, respectively.

Other embodiments of this invention include a full body pillow having a curved head support portion with a linear extension and, optionally, a second curved extension. These full body embodiments are designed to provide a larger support range for the arms as they rotate about the shoulders and elbows and a support range for the legs as they rotate about the hips and knees.

DETAILED DESCRIPTION OF THE INVENTION AND THE PREFERRED EMBODIMENTS THEREOF

Figure 1:
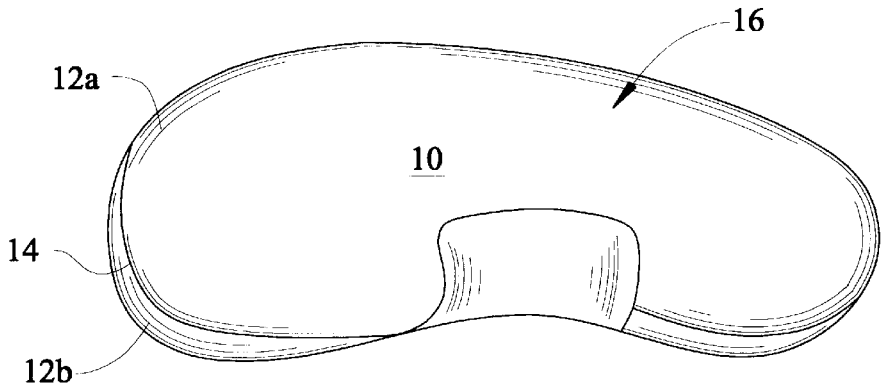
FIG. 1 is a perspective view of a pillow in accordance with the present invention.

Considering now the drawings in detail, a pillow constructed in accordance with the invention is represented generally therein by the numeral 10 and the full body embodiments as 30 and 40. The reference numerals for like parts have been maintained through the different embodiments depicted in the FIGS. (e.g. additional panel 8, panels 12(*a* & *b*), seam 14, casing 16, and stuffing material 18).

Referring to FIG. 1, pillow 10 has a substantially planar curved shape. The pillow 10 is conveniently constructed from a pair of identical panels 12(*a* & *b*) of material, typically woven cloth, joined together around their periphery with a seam 14 to form an outer casing 16. Since the bottom panel is in alignment with the top panel in all the embodiments depicted in the FIGS., it is not shown in the plan views. The casing 16 is stuffed with a fill or stuffing material 18, shown in FIG. 4, such as a polyester fiber or other suitable synthetic or natural fill materials. The casing 16, which is formed of two identical panels each having a uniform width, has a substantially uniform cross section.

Figure 2:
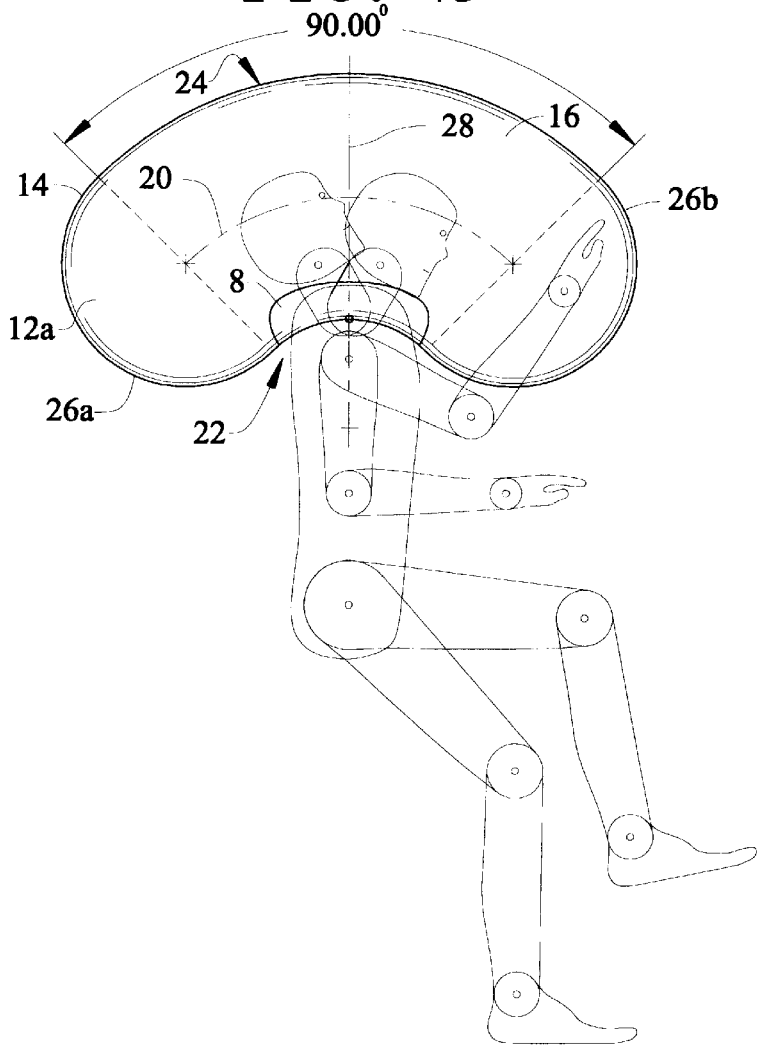
FIG. 2 is a plan view of the pillow in FIG. 1, with a range of movements of a user shown in phantom.

The panels 12(*a* & *b*) have a fixed radius arc shape, as best shown in FIG. 2. The notional longitudinal centerline 20 of the panels 12(*a* & *b*) is a substantially fixed radius arc. The inside edge 22 and outside edge 24 of the panel each have a substantially fixed radius arc shape. The ends 26(*a* & *b*) of the panels 12(*a* & *b*) have a fixed radius smooth curve extending from the inside edge 22 to the outside edge 24. It should be appreciated that the ends may alternatively be straight, curved, extended, or assume any other suitable shape. The panels 12(*a* & *b*) are preferably symmetrical about the notional transverse centerline 28.

The panels 12(*a* & *b*) have a substantially uniform width throughout their curved length which means that the inside edge 22 and outside edge 24 are concentrically arranged and their is a substantially fixed distance maintained therebetween. In addition, the angle of the arc shapes of the inside and outside edges are essentially the same. For example, the inside edge 22 and the outside edge 24 may complete an arc angle of about 90°, as shown in FIG. 2.

Since the panels 12(*a* & *b*) have a fixed radius arc shape, their length can be described by an arc angle which should be at least 60°. This minimal angle provides a support range corresponding to the more common range of the rotational movement of the user's head. Preferably, the panels will complete an arc no greater than about 180° so that the partially encircled open area defined by the panel or pillow does not tend to restrict or bind the user. The most preferred angular length of the panels is between about 90° and about 120°.

The panels 12(*a* & *b*) can be constructed in a variety of sizes to form pillows that accommodate users having different proportions. Generally, the radius of the inside edge 22 and the outside edge 24 can be separately varied to provide pillows having different sizes and widths. Typically, the radius of the fixed radius curve of the inside edge 22 will be between about 3 and about 10 inches while the radius of the fixed radius curve of the outside edge 24 may be varied to provide a pillow having a suitable width.

Figure 4:
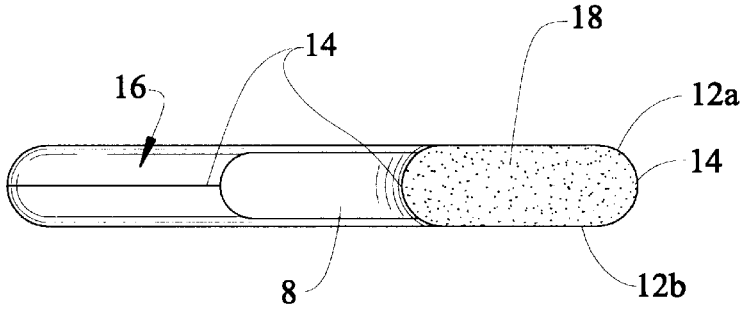
FIG. 4 is a section view of the pillow in FIG. 3*a* taken along line 4—4.

Referring now to FIGS. 2 & 4, the seam 14, which joins the two identical panels, defines the peripheral edge of the casing 16 and the periphery of the horizontal midsection of the pillow. Since the pillow assumes a generally elliptical or oval shaped cross section, the seam 14 is positioned at the apex of the sides of the pillow. In order to eliminate point contact between the seam and the user, particularly the user's shoulder, a portion of the seam 14 on the inside edge of the pillow is redirected off the mid-section. The seam 14 may be redirected by employing an additional panel of material 8 between the panels 12(*a* & *b*). The additional panel of material may extend the full length of the inside edge or more. Preferably, the additional panel of material 8 will extend along a portion of the inside edge of the pillow and be centered about the midsection and transverse centerline of the pillow.

Figure 3B:
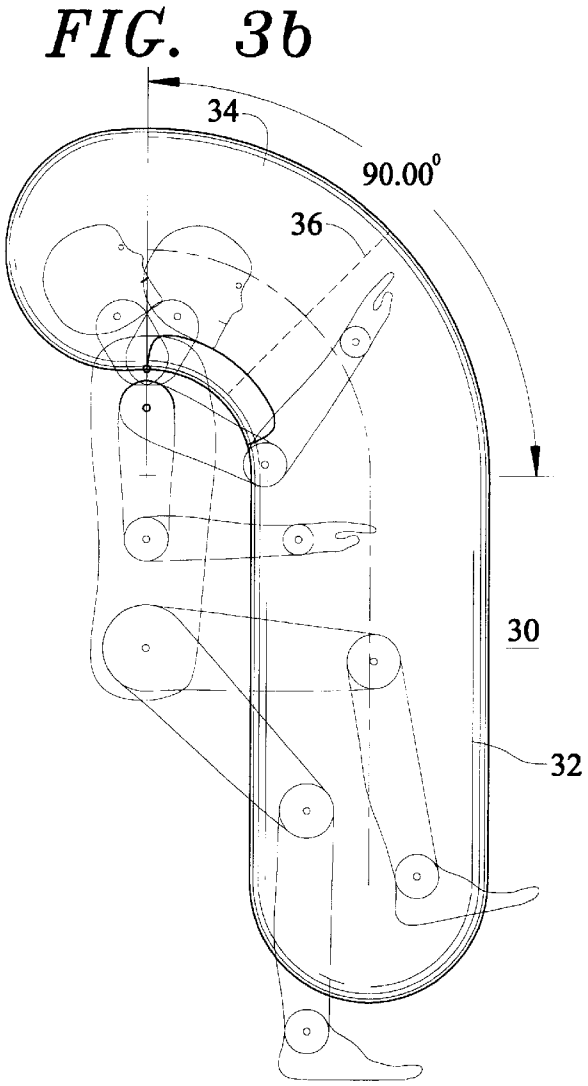
FIG. 3*b* is a plan view of a modified version of the full body pillow shown in FIG. 3*a* having a 90° arc portion.
Figure 3A:
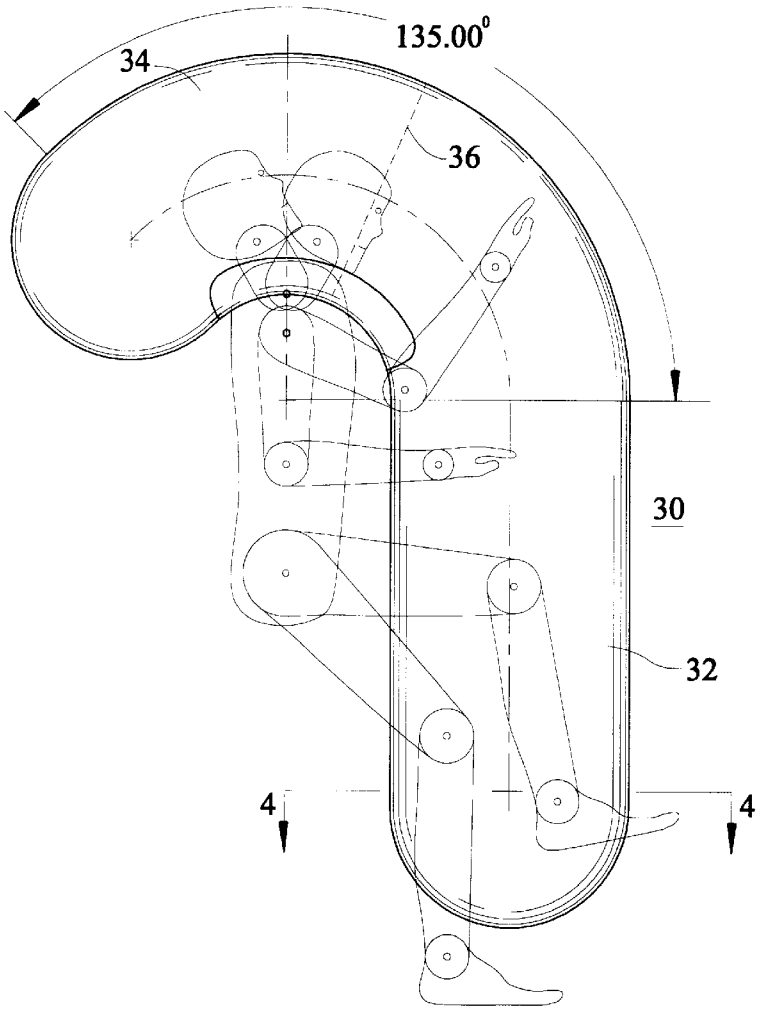
FIG. 3*a* is a plan view of a full body pillow in accordance with the present invention with a 135° arc portion, with a range of movements of a user shown in phantom.

A full body pillow 30, as shown in FIGS. 3*a* & *b*, represents a second embodiment of the invention. The full body pillow comprises a substantially fixed radius arc portion 34, substantially identical to the pillow discussed above, and a linear extended portion 32 which offers support for the arms and legs of the user. The linear extended portion 32 extends from the end of the substantially fixed radius arc portion 34. The pillow can be constructed from two identical panels, similar to the pillow described above, wherein the panels each have a linear extended portion. The linear extended portion 32 will preferably be the same width as the arc portion 34 so that the panels have a continuous uniform width through both portions. Although the length of the arc portion 34 can range in size and width as described above, the preferred configuration of the full body pillow has between about 90° and about 135° arc portion 34 so that the notional transverse centerline 36 of the arc portion forms an angle of between about 45° and about 67.5° with the linear extended portion 32.

Figure 5:
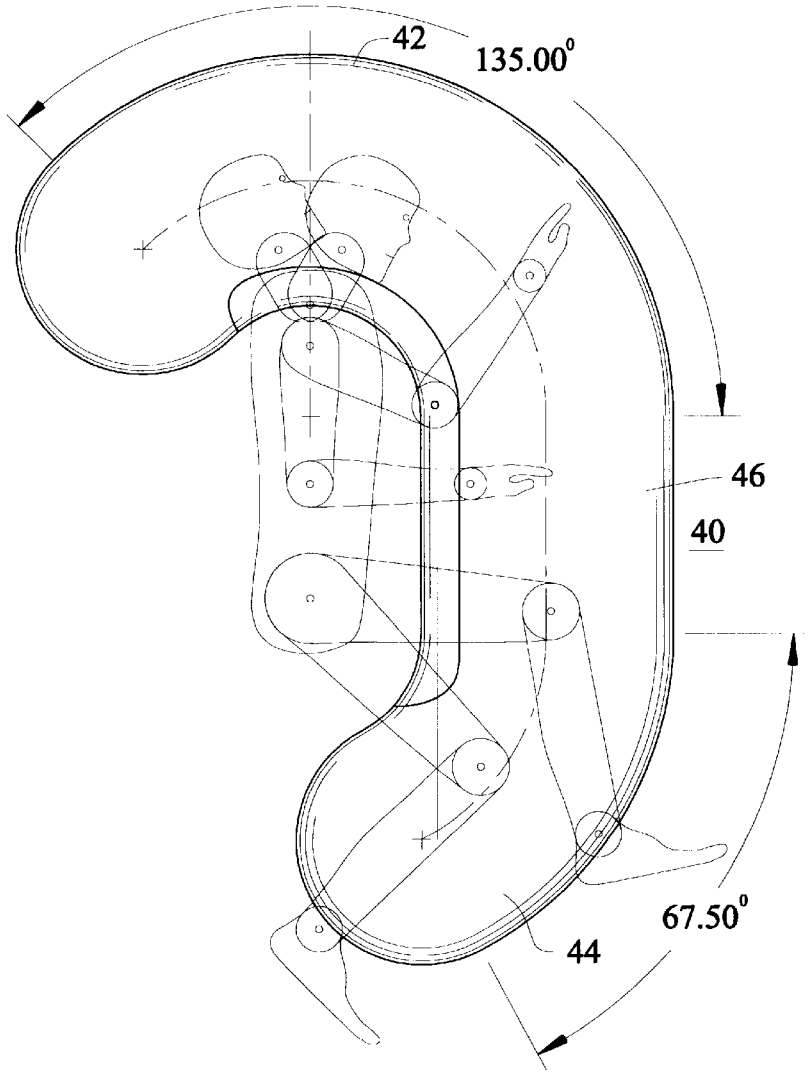
FIG. 5 is a plan view of another embodiment of a full body pillow in accordance with the present invention, with a range of movements of a user shown in phantom.

Another embodiment of the full body pillow 40 is shown in FIG. 5. This embodiment of the full body pillow 40 comprises two curved portions 42 & 44 extending from opposite ends of a linear portion 46. The curved portions are within the same plane and curve toward the same side of the linear portion 46 to define a partially encircled open area for receiving a user. Preferably, the upper curved portion 42 will have a substantially fixed radius arc shape and range in size and width as described above. Similarly, the lower curved portion 44 will preferably have a substantially fixed radius arc shape and the arc will be of an angle equal to or less than the upper portion.

It will be appreciated that the pillows of the present invention may be constructed from any types of material suitable for this purpose. The casing of the pillow may be integrally formed or may be composed of multiple panels and/or parts. As discussed above, the panels may be identical, including mirror images, or different. The pillow may optional comprise one or more quilting stitches or other means to restrict the filler movement within the casing.

While particular configurations have been depicted and described herein, the above description is intended to convey an understanding of the present invention. Modifications within the scope of the invention will be obvious to those skilled in the art. Therefore, the scope of the invention should be determined solely by reference to the appended claims.

What is claimed is:

1. A pillow having a central pillow section comprising a circumferential segment of a toroid having a first end and a second end and first and second ellipsoidal pillow end sections, each having an open end and a closed end, said open end of said first ellipsoidal pillow end section being connected to said central pillow section first end and said open end of said second ellipsoidal pillow end section being connected to said central pillow section second end, said pillow further including a cylindrical pillow section having a first end connected to said central pillow section second end and a second end, a second circumferential segment of a toroid having a first end connected to said cylindrical pillow section second end and a second end connected to said open end of said second ellipsoidal pillow section.

2. The pillow of claim 1 wherein the cross section of said central pillow section is substantially the same as the cross section of said first ellipsoidal pillow end section near said open end.

3. The pillow of claim 1 wherein said circumferential segment has an angle of between about 60 and 120 degrees.

4. The pillow of claim 1 wherein said circumferential segment has an angle of between about 90 degrees and 120 degrees.

5. The pillow of claim 1 further including a cylindrical pillow section having a first end connected to said central pillow section second end and a second end connected to said second ellipsoidal end section open end.

6. The pillow of claim 5 wherein the cross section of said cylindrical pillow section is generally elliptical.

7. The pillow of claim 6 wherein the distance between said first and second ends of said cylindrical pillow section is greater than the distance between the first and second ends of said central pillow section.

8. The pillow of claim 6 wherein the cross section of said cylindrical pillow section at said cylindrical pillow section first end is substantially identical to the cross section of said central pillow section at said central pillow section second end.

9. The pillow of claim 8 wherein the cross section of said cylindrical pillow section at said cylindrical pillow section second end is substantially identical to the cross section of said second ellipsoidal end section at said open end.

10. The pillow of claim 1 wherein the angle of said second circumferential segment is less than or equal to the angle of said first circumferential segment.

11. The pillow of claim 1 wherein the cross section of said second circumferential pillow segment is elliptical.

12. The pillow of claim 1 wherein the cross section of said second circumferential pillow segment at said first end is substantially identical to the cross section of said cylindrical pillow segment at said second end.

13. A pillow having:

a first central pillow section comprising a circumferential segment of a toroid having a first end and a second end, the angle of said circumferential segment being between about 90 and 120 degrees;

a first ellipsoidal pillow end section having an open end connected to said first central pillow section first end and a closed end;

a cylindrical pillow section having a first end connected to said central pillow section second end and a second end;

a second circumferential segment of a toroid having a first end connected to said cylindrical pillow section second end and a second end;

a second ellipsoidal pillow end section having an open end connected to said second circumferential segment second end and a closed end.

14. The pillow of claim 13 wherein said first end of said first circumferential segments of a toroid and said second end of said second circumferential segment of a toroid are both curved toward a first direction.

* * * * *